US006230890B1

(12) United States Patent
Waver et al.

(10) Patent No.: US 6,230,890 B1
(45) Date of Patent: May 15, 2001

(54) PACKAGED ADHESIVE MASS

(75) Inventors: Bruce A. Waver, Cary, NC (US); David E. Mechling, Cumberland Furnace; Barclay S. Hickman, Centerville, both of TN (US); Leon Bildusas, Raleigh, NC (US)

(73) Assignee: Reichhold Chemicals, Inc., Durham, NC (US)

( * ) Notice: Subject to any disclaimer, the term of this patent is extended or adjusted under 35 U.S.C. 154(b) by 0 days.

(21) Appl. No.: 09/505,754

(22) Filed: Feb. 16, 2000

Related U.S. Application Data

(60) Division of application No. 09/048,146, filed on Mar. 3, 1998, now Pat. No. 6,044,625, which is a continuation-in-part of application No. 08/824,470, filed on Mar. 26, 1997, now Pat. No. 6,006,497.

(51) Int. Cl.[7] ..... B65D 71/00

(52) U.S. Cl. ..... 206/447; 206/497; 206/499

(58) Field of Search ..... 53/440, 447, 411, 53/122, 127, 131.1, 157; 264/255, 264; 427/133, 202, 203; 206/447, 497, 499

(56) References Cited

U.S. PATENT DOCUMENTS

| | | | |
|---|---|---|---|
| 1,666,730 | 4/1928 | Breeze, Jr. . | |
| 2,639,808 | 5/1953 | Barry et al. | 206/84 |
| 2,762,504 | 9/1956 | Sparks et al. | 206/84 |
| 2,829,073 | 4/1958 | Williams | 117/161 |
| 2,985,554 | 5/1961 | Dickard | 154/53.5 |
| 3,111,449 | 11/1963 | Gold et al. | 161/151 |
| 3,152,030 | 10/1964 | Sampson | 156/278 |
| 3,301,741 | 1/1967 | Henrickson et al. | 161/119 |
| 3,314,536 | 4/1967 | Janota et al. | 206/84 |
| 3,341,004 | 9/1967 | Hoeglund | 206/59 |
| 3,403,045 | 9/1968 | Erickson et al. | 117/68 |
| 3,469,363 | 9/1969 | Berckmoes | 53/25 |
| 3,509,991 | 5/1970 | Hurst | 206/59 |
| 3,564,808 | 2/1971 | Kent | 53/25 |
| 3,837,778 | 9/1974 | Parker | 425/256 |
| 3,851,438 | 12/1974 | Brisman | 53/23 |
| 3,950,207 | 4/1976 | de Zuloaga Amat | 156/308 |
| 4,004,619 | 1/1977 | Eddlemon et al. | 141/11 |
| 4,054,474 | 10/1977 | Collins et al. | 53/442 X |
| 4,054,632 | 10/1977 | Franke | 264/145 |
| 4,106,261 | 8/1978 | Greenawalt | 53/27 |
| 4,137,692 | 2/1979 | Levy | 53/440 |
| 4,194,438 | 3/1980 | Schmachtel | 93/20 |
| 4,229,972 | 10/1980 | Rozmus | 29/420 |

(List continued on next page.)

FOREIGN PATENT DOCUMENTS

| | | |
|---|---|---|
| 2161990 | 7/1972 | (DE) . |
| 3 234 065 A1 | 4/1983 | (DE) . |

(List continued on next page.)

OTHER PUBLICATIONS

Brochure, Chub Packaging Machines by Kartridg Pak, undated.

Brochure, Kartridg Pak Commitment to Product Support, undated.

Brochure, Rovemar, Vertical Bagger VPX, undated.

Voneiff–Gibson Corporation, TPA Equipment Systems, Automated Industrial Class Shrink Packaging Equipment.

*Primary Examiner*—Jim Foster

(74) *Attorney, Agent, or Firm*—Myers Bigel Sibley & Sajovec, P.A.

(57) ABSTRACT

A method for packaging a hot melt adhesive mass comprises providing a hot melt adhesive having a predetermined viscosity and finite size and shape, and encapsulating the hot melt adhesive in a polymeric shrink wrap which forms a hermetic seal thereon. An packaged adhesive mass comprises a hot melt adhesive having a predetermined viscosity and a finite size and shape; and a polymeric shrink wrap film which encapsulates the hot melt adhesive. The hot melt adhesive is hermetically sealed.

8 Claims, 5 Drawing Sheets

U.S. PATENT DOCUMENTS

| | | | |
|---|---|---|---|
| 4,275,864 | 6/1981 | Richards | 249/79 |
| 4,306,657 | 12/1981 | Levy | 206/447 |
| 4,334,615 | 6/1982 | Butler et al. | 206/447 |
| 4,335,560 | 6/1982 | Robinson | 53/440 |
| 4,450,878 | 5/1984 | Takada et al. | 141/48 |
| 4,450,962 | 5/1984 | Matthews et al. | 206/447 |
| 4,524,566 | 6/1985 | Hauers et al. | 53/534 |
| 4,681,712 | 7/1987 | Sakakibara et al. | 264/24 |
| 4,748,796 | 6/1988 | Viel | 53/411 |
| 4,750,313 | 6/1988 | Kammier et al. | 53/451 |
| 4,755,245 | 7/1988 | Viel | 156/227 |
| 4,840,823 | 6/1989 | Chigami et al. | 428/35.5 |
| 4,947,618 | 8/1990 | Schneider et al. | 53/373 |
| 4,984,413 | 1/1991 | Cosmo | 53/464 |
| 5,031,386 | 7/1991 | Schneider | 53/551 |
| 5,109,892 | 5/1992 | Somers | 141/11 |
| 5,112,552 | 5/1992 | Wittmann et al. | 264/255 |
| 5,117,612 | 6/1992 | Keim et al. | 53/451 |
| 5,158,815 | 10/1992 | Doheny, Jr. et al. | 428/34.9 |
| 5,160,686 | 11/1992 | Thaler et al. | 264/255 |
| 5,170,608 | 12/1992 | Petry et al. | 53/377.2 |
| 5,191,750 | 3/1993 | Kammler | 53/551 |
| 5,203,145 | 4/1993 | Kammler et al. | 53/552 |
| 5,241,804 | 9/1993 | Tsuruta et al. | 53/504 |
| 5,257,491 | 11/1993 | Rouyer et al. | 53/428 |
| 5,307,608 | 5/1994 | Muir et al. | 53/440 |
| 5,333,439 | 8/1994 | Bozich et al. | 53/450 |
| 5,373,682 | 12/1994 | Hatfield et al. | 53/440 |
| 5,392,592 | 2/1995 | Bozich et al. | 53/440 |
| 5,398,486 | 3/1995 | Kauss et al. | 53/551 |
| 5,401,455 | 3/1995 | Hatfield et al. | 264/255 |
| 5,472,089 | 12/1995 | Specogna et al. | 206/413 |
| 5,528,743 | 6/1996 | Tou et al. | 395/148 |
| 5,715,654 | 2/1998 | Taylor et al. | 53/440 |
| 5,804,610 | 9/1998 | Hamer et al. | 53/440 X |
| 5,819,505 | 10/1998 | Fayolle et al. | 53/440 |

FOREIGN PATENT DOCUMENTS

| | | |
|---|---|---|
| 31 38 222C1 | 5/1983 | (DE) . |
| 3 327 289 A1 | 7/1985 | (DE) . |
| 86 28 513 | 1/1987 | (DE) . |
| 87 10 132 | 10/1987 | (DE) . |
| 3 625 358 | 4/1988 | (DE) . |
| 0 017 394 A2 | 3/1980 | (EP) . |
| 0 469 564 A1 | 7/1991 | (EP) . |
| 0 521 661 A1 | 6/1992 | (EP) . |
| 0412867 | 9/1993 | (EP) . |
| 0649718A1 | 4/1995 | (EP) . |
| 2 489 351 | 4/1980 | (FR) . |
| 2 544 654 | 4/1983 | (FR) . |
| 2 601 616 | 7/1986 | (FR) . |
| 2 603 021 | 8/1986 | (FR) . |
| 2 541 966 | 1/1988 | (FR) . |
| 2 156 302 | 9/1985 | (GB) . |
| 48-103635 | 12/1973 | (JP) . |
| WO97/27112 | 7/1997 | (WO) . |

FIG. 4
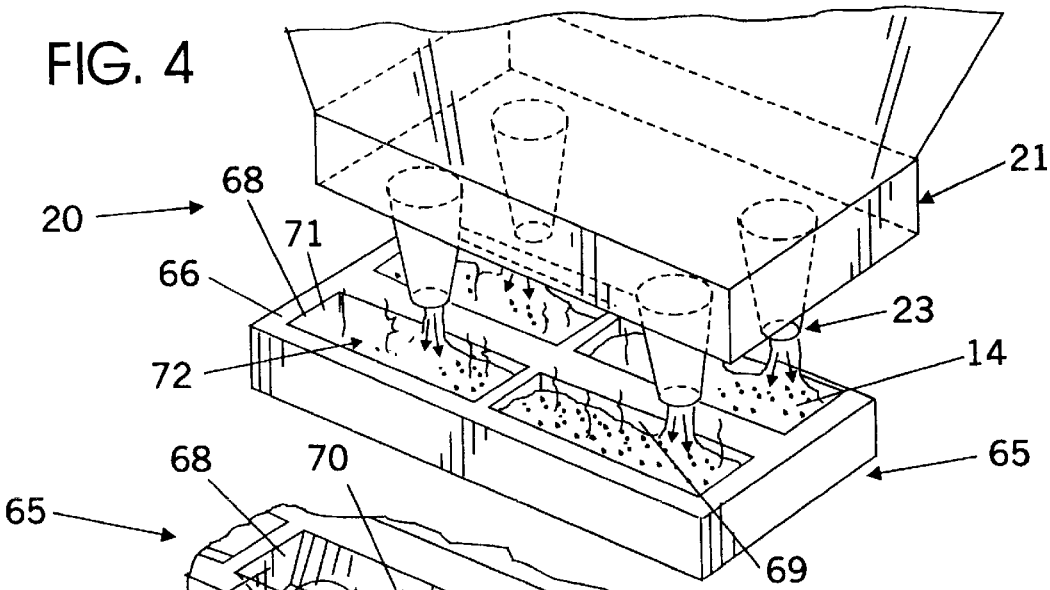
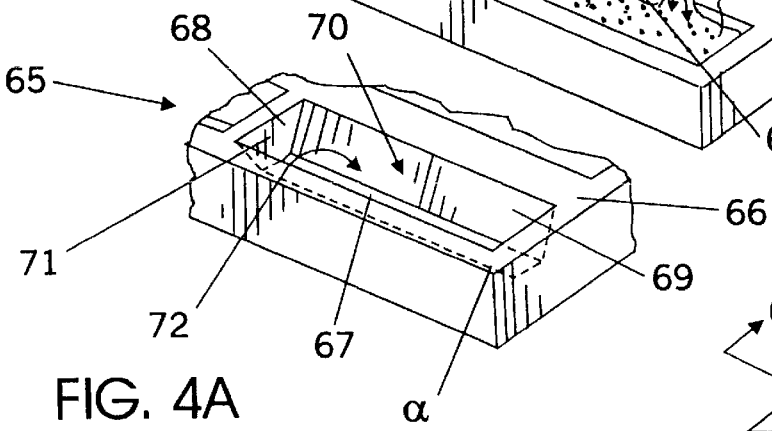
FIG. 4A
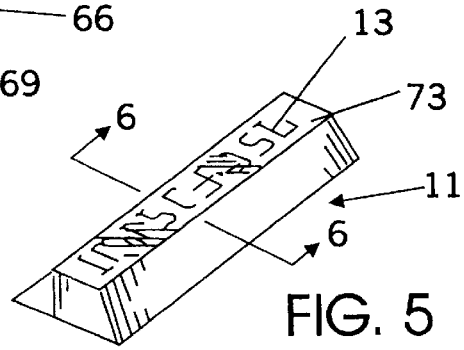
FIG. 5
FIG. 6
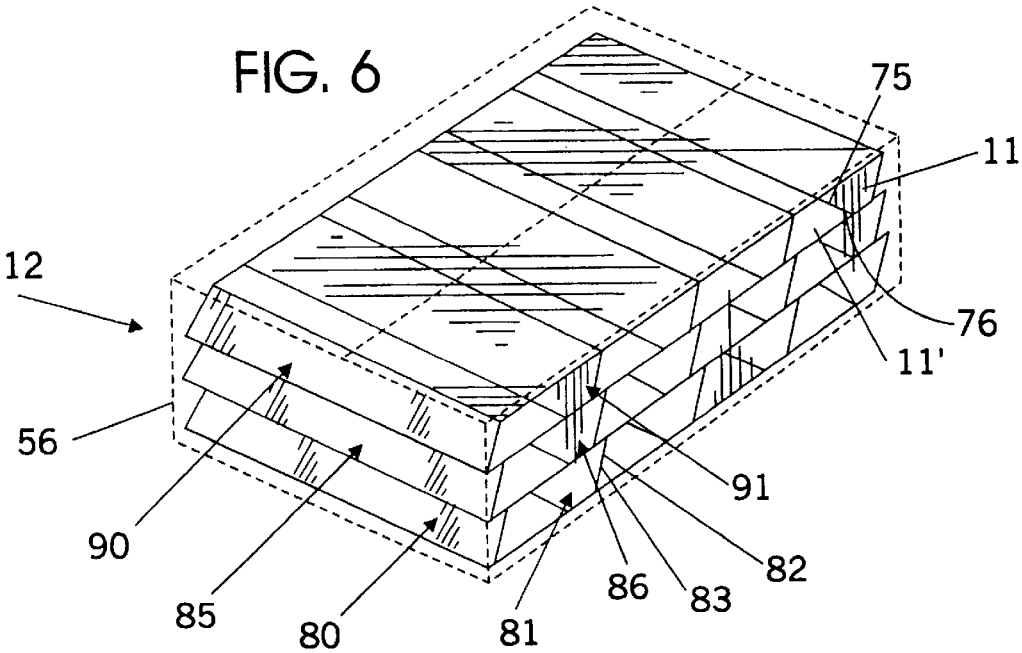

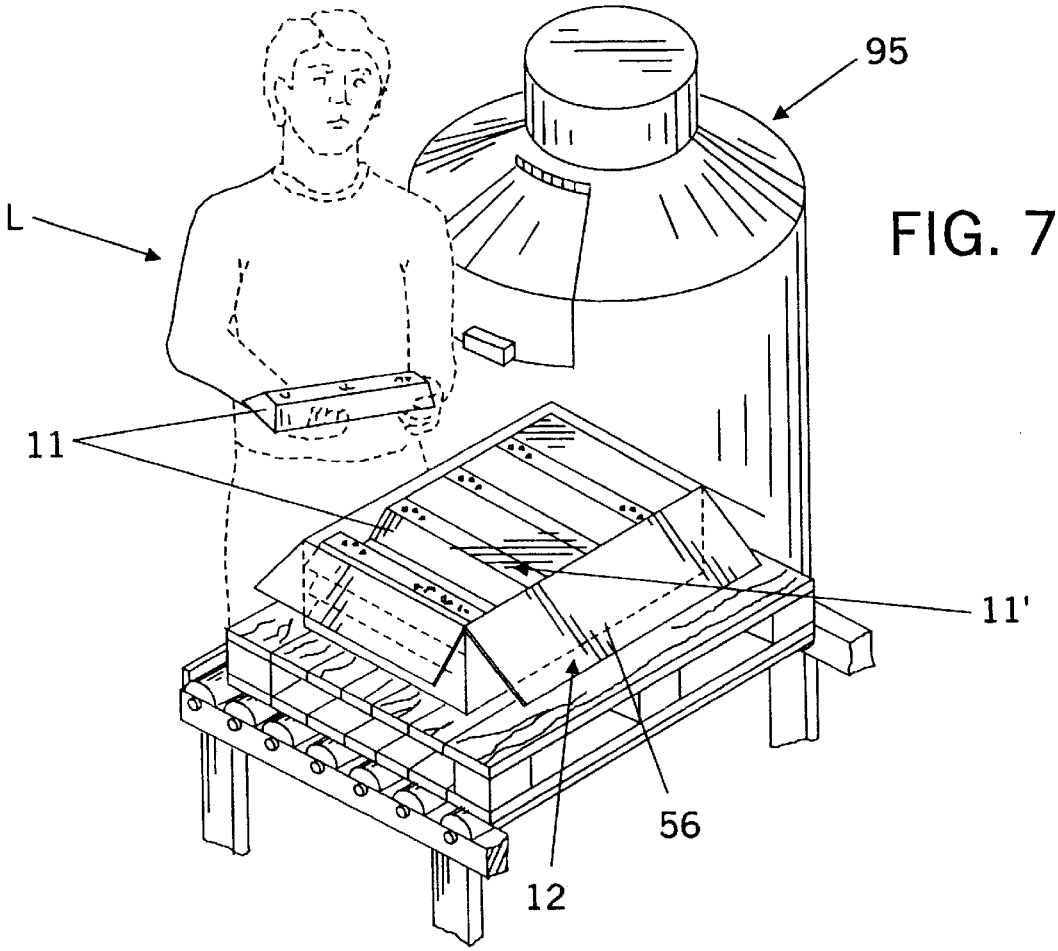
FIG. 7
FIG. 9
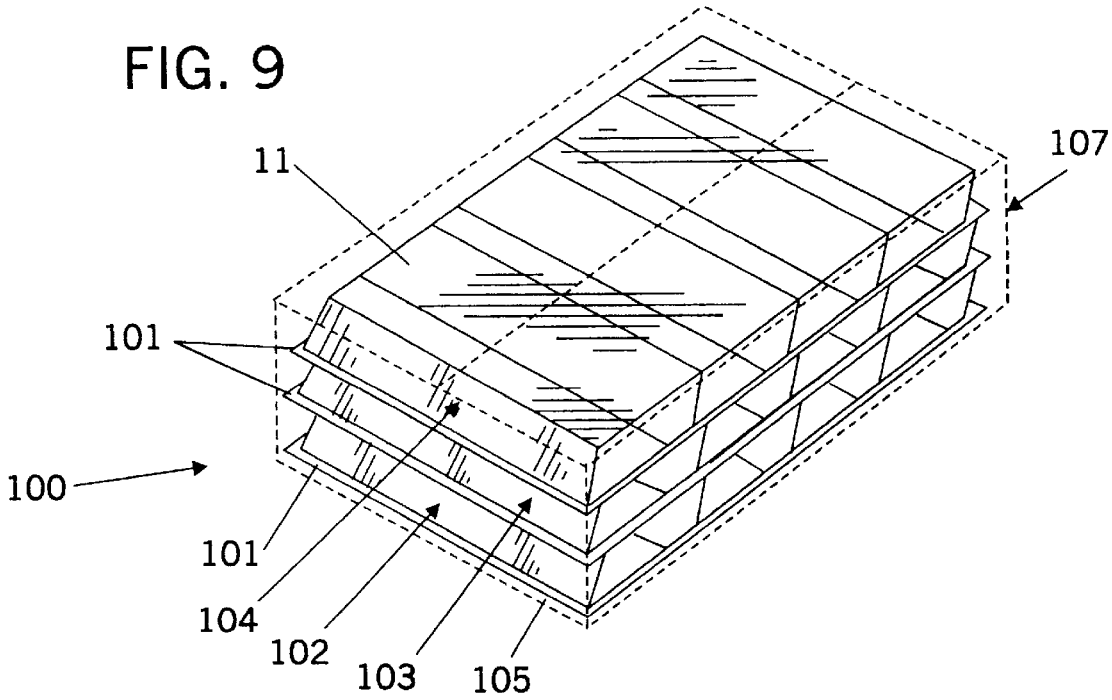

PACKAGED ADHESIVE MASS

CROSS REFERENCE TO RELATED APPLICATIONS

The instant application is a divisional application of Ser. No. 09/048,146 filed Mar. 3, 1998, now U.S. Pat. No. 6,044,625, which is a continuation-in-part application of Ser. No. 08/824,470 filed Mar. 26, 1997, now U.S. Pat. No. 6,006,497, the disclosures of which are incorporated herein by reference in their entirety.

FIELD OF THE INVENTION

The present invention generally relates to the preparation and packaging of hot melt adhesives.

BACKGROUND OF THE INVENTION

Hot melt adhesives are recognized as adhesives which are tacky when applied in a molten or "hot melt" state. These hot melt adhesives, including pressure sensitive, hot melt adhesives, are typically solids and often tacky at room temperature.

Hot melt adhesives are generally supplied to customers in rigid form for adding to glue pots or other hot melt adhesive processing equipment for melting prior to application. Hot melt adhesives, particularly pressure sensitive adhesives, are also generally supplied to customers at room temperature at which they are extremely tacky. The adhesive properties of pressure sensitive, hot melt adhesives have produced problems in preparation, packaging, transport, use, and processing. For example, pressure sensitive, hot melt adhesives have adhered to other pressure sensitive, hot melt adhesives during packaging, shipping, and storage. Further, hot melt adhesives have adhered to packaging materials such as plastic films, papers or cardboard cartons in various processing conditions.

Attempts have been made to package hot melt adhesives in rigid block portions surrounded by films or other packaging which must be removed prior to supplying the adhesive to a melting pot or other processing equipment. For example, methods and apparatus for packaging hot melt adhesives have been attempted utilizing polymer films filled with molten hot melt adhesive. The high temperature of the molten adhesive has caused melting of certain films including polymer films such that the resulting materials cannot be easily handled.

Various of these packaging films have been utilized with certain cooling methods such as water sprays or baths applied to the film during and immediately after filling with the molten, hot melt adhesive. Such packaging processes require elaborate and costly steps and equipment to cool the film during filling. Examples of such water cooled systems are described in U.S. Pat. Nos. 5,373,682 and 5,401,455 to Hatfield. Other plastic films have been utilized to surround individual adhesive masses for packaging to prevent adhesion of the adhesive with other adhesives or packaging.

Attempts have also been made to coat a hot melt adhesive with an anti-adhesive coating prior to wrapping with a plastic film. One such example is proposed in EPO patent 412,867. Also, a micronized powder has been utilized with a silicone coated polymer film to wrap adhesives as proposed in U.S. Pat. No. 5,392,592 to Bozich.

In attempts which have utilized packaging such as preformed heavy containers to surround individual adhesive masses, the packaging must be removed from each adhesive mass prior to introducing the adhesive into the melting pot or processing equipment. These heavy containers, boxes, and other wrappers or packages, once removed, create waste and disposal problems.

All of these individually packaged masses which must be removed from individual packaging prior to the introduction into a glue pot, increase time, costs, including labor costs, and waste during application of the adhesive. Such individually packaged adhesives may require repetitive tasks of unwrapping by manual labor.

Other attempts have been made to package adhesives utilizing trays or molds formed of a material having non-stick properties or coated with non-tacky material. The adhesive generally has been shipped and transported in these trays for use by the customer where an operation removes the hot melt adhesive product from the tray prior to introduction into the glue pot. The adhesive has been transported in the trays due to the tackiness of the adhesive. Such trays or molds have also been coated with castor oil or powder held in position with static electricity. Generally these trays are costly and produce waste. Such slow cooled adhesive in molds have then generally been individually packaged in film or other exterior individual packaging prior to shipping. One such mold is proposed in U.S. Pat. No. 4,748,796 to Viel.

Another proposal to provide readily available hot melt adhesive products has focused on dusting the adhesive with a thermoplastic, hard, non-blocking, wax powder. By virtue of this technique, it was attempted to eliminate the use of packaging material such that the dusted adhesive could be placed directly into a melting pot. Although the dusting technique is desirable in certain instances, potential difficulties may exist with respect to this method. As an example, the dusting may not be completely effective in that the dusted blocks may stick together making them potentially difficult to separate from each other.

There is therefore a need to provide methods and apparatus for preparing potentially more environmentally friendly individual hot melt adhesive packaged masses, particularly of the pressure sensitive type, which reduces time and costs, including labor costs and steps. It would be particularly desirable to obtain a packaged adhesive mass which may be placed unwrapped into a melting pot.

SUMMARY OF THE INVENTION

In view of the above, it is an object of the present invention to provide a methods of packaging an adhesive which is more efficient in terms of time and costs, particularly those associated with labor.

It is another object of the present invention to provide a packaged adhesive mass which may be easily handled and can be used in its entirety during adhesive melting so as to generate minimal or no waste.

It is a further object of the present invention to provide a method of packaging an adhesive which is potentially more environmentally friendly in that the packaging material does not have to be disposed separately from the hot melt adhesive.

These and other objects and advantages are provided by the present invention. Specifically, the invention provides a method of packaging a hot melt adhesive mass. The method comprises providing a hot melt adhesive having a predetermined viscosity and a finite size and shape. Advantageously, the adhesive may be in a tacky or substantially tack-free state. The hot melt adhesive is then encapsulated in a polymeric shrink wrap which forms a hermetic seal thereon. For the purposes of the invention, the term "hermetic seal"

refers to the shrink wrap being present around the hot melt adhesive such that substantially no air is present therein and virtually no air, outside gas, water, foreign matter (e.g., dirt, contamination), and the like may permeate the shrink wrap.

In accordance with the invention, the resulting packaged article may be employed in a melting process such that the shrink wrap melts along with the adhesive in a melting pot. As a result, the molten mass may proceed from the melting location without plugging downstream pumps, delivery hoses, fillers, or extrusion nozzles. The melted film also does not interfere with adhesion or tack. Preferably, the shrink wrap has a melting point equal to or lower than about 266° C.

Prior to being encapsulated in the polymeric shrink wrap, the hot melt adhesive may be subjected to various processes. In one embodiment, a method of preparing a hot melt adhesive mass for packaging comprises filling a mold with a hot melt adhesive having a predetermined viscosity and a predetermined first temperature; subjecting the hot melt adhesive in the mold to a chilling medium to chill the adhesive to a second temperature between about −5° C. to about −20° C. to form a prepackage, hot melt adhesive mass having a substantially tack-free outer surface; removing the prepackage, hot melt adhesive mass from the mold; and dusting the outer surface of the prepackage, hot melt adhesive mass with a non-stick dusting agent so as to maintain a substantially tack-free surface as the temperature therefore rises to a third temperature between about 0° C. and 75° C.

BRIEF DESCRIPTION OF THE DRAWINGS

FIG. 4 is an exploded view of the filler supplying hot melt, pressure sensitive adhesive into a tray of FIG. 3.

FIG. 4A is a partial perspective view of the tray of FIG. 4.

FIG. 5 is a perspective view of a hot melt adhesive mass produced by the methods and apparatus depicted in FIG. 3.

FIG. 6 is a perspective view of an alternative embodiment of a packaged, hot melt adhesive product.

FIG. 7 shows a perspective view of an adhesive mass being removed from the hot melt adhesive packaged product in preparation for processing by an operator.

FIG. 9 is a cutaway view of an alternative embodiment of a packaged, hot melt adhesive product.

DETAILED DESCRIPTION OF THE INVENTION

Figure 1:
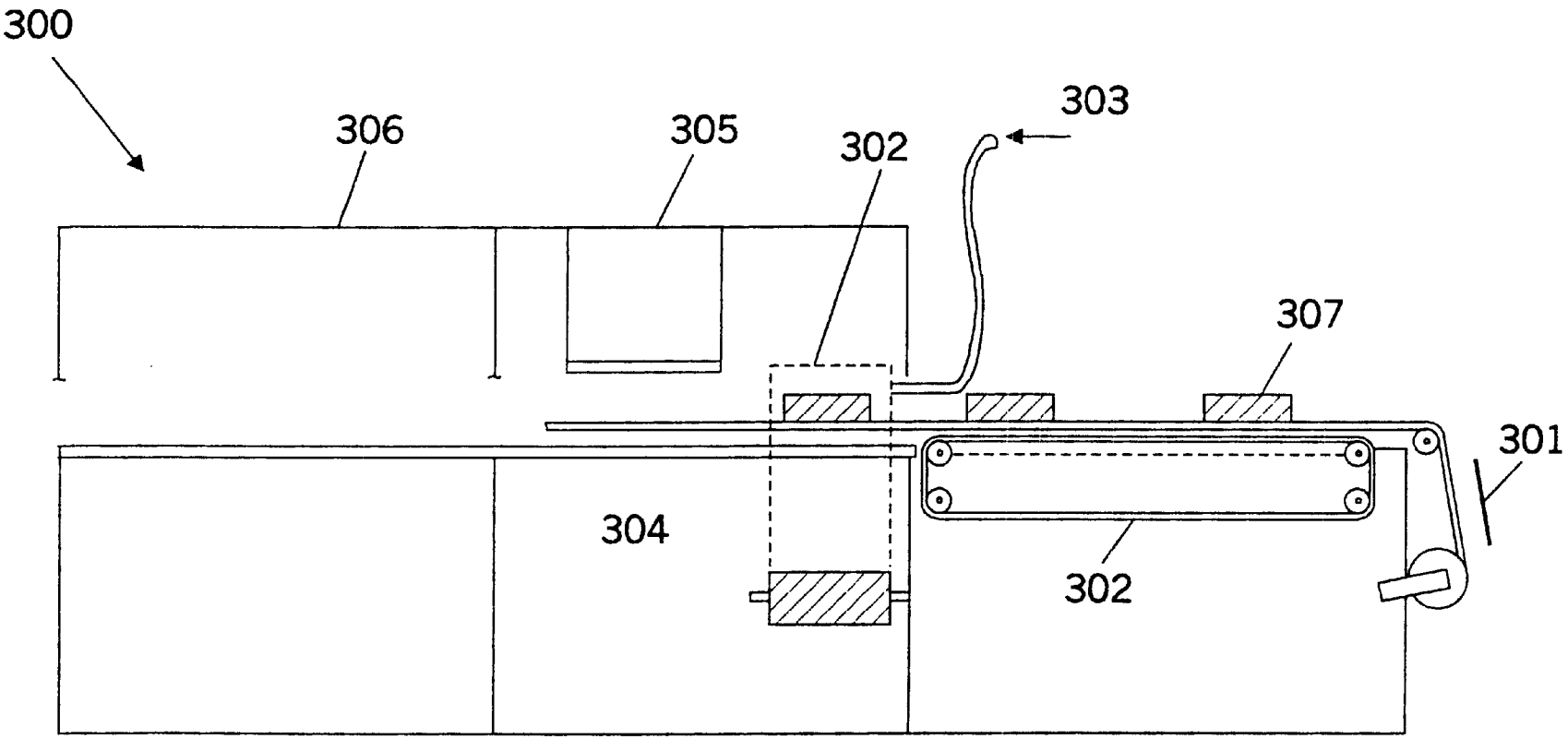
FIG. 1 is a side view of an apparatus and method for preparing hot melt adhesive masses which are encapsulated in polymeric shrink wrap.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

In one aspect, the invention relates to a method for packaging a hot melt adhesive mass. The method comprises providing a hot melt adhesive having a predetermined viscosity and finite size and shape. The hot melt adhesive is thereafter encapsulated in a polymeric shrink wrap which forms a hermetic seal thereon.

For the purposes of the invention, the term "hot melt adhesive" is to be broadly construed by one who is skilled in the art. Examples of hot melt adhesives are provided in U.S. Pat. Nos. 3,239,478; 3,954,692; and 4,500,021, the disclosures of which are incorporated herein by reference in their entirety. The hot melt adhesive which is used in the invention may be in a substantially tack-free or tacky state. The hot melt adhesive may be prepared in accordance with known techniques, and also may be subjected to any of the procedures (e.g., dusting, chilling) described herein.

Typically, the hot melt adhesive is present in the form of a pressure sensitive adhesive. Suitable materials for use in the hot melt adhesives include, but are not limited to, polymers, block polymers, and copolymers of polyacrylates, SIS, SBS, SEBS block polymers, polyvinyl acetates, ethylene esters and copolymers (e.g., ethylene vinyl acetate, ethylene methacrylate, etc.), polystyrenes, polyesters, polyamides, polyurethanes, polyepoxides, and aldehyde-containing resins (e.g., phenolaldehyde resins), and blends and mixtures thereof. Additionally, the hot melt adhesives may include other additives which are known to one skilled in the art. These adhesives may encompass tackifying resins to improve adhesion and introduce tack into the adhesive. Such resins include, among other materials, natural and modified resins; polyterpene resins; phenolic modified hydrocarbon resins; coumaroneindene resins; aliphatic and aromatic petroleum hydrocarbon resins; phthalate esters; and hydrogenated hydrocarbons, hydrogenated rosins, and hydrogenated rosin esters. Plasticizers, waxes, and antioxidants may also be employed as described in U.S. Pat. No. 3,239,478, the disclosure of which is incorporated herein by reference in its entirety.

The polymeric shrink wrap which may be used in the invention is formed from materials which are known to one who is skilled in the art. Examples of components which may be used in the polymeric shrink wraps are found in U.S. Pat. Nos. 5,158,815; 5,528,743; 4,984,413; and 5,472,089, the disclosures of which are incorporated herein by reference in their entirety. The term "polymeric" is to be broadly construed to include homopolymers, copolymers, terpolymers, and the like. The polymeric shrink wrap is typically formed from thermoplastic materials. Components which may be used in the polymeric shrink wraps include polyolefins such as, but are not limited to, polyethylenes, (e.g., low density polyethylene (LDPE), medium density polyethylene (MDPE), high density polyethylene (HDPE), very low or ultra low density polyethylene (VLDPE), linear low density polyethylene (LLDPE), and polyvinyl ethylene vinyl acetate. Copolymers of the above polyolefins are also contemplated. In addition, other polymers may be used in combination with the above materials such as, for example, ethylene vinyl acetate copolymers, ethylene propylene rubber, EPDM, polypropylene, polyvinyl chloride, polyisobutylene, conjugated diene butyl, butyl rubber, and the like. Blends and mixtures of the above may also be used. A commercially preferred polymeric shrink wrap is Clysar® LLP film sold by the Du Pont Company of Wilmington, Del.

The polymeric shrink wrap may also comprise other reagents and additives which are known to one skilled in the art. Such materials include, but are not limited to, a colorant such as dyes, antioxidants, ultra-violet stabilizers, anti-blocking agents, and the like.

Preferably, the polymeric shrink wrap have a melting point of equal to or lower than 266° F. For the purposes of the invention, in another preferred embodiment, the polymeric shrink wrap has a melting point which is lower than the application temperature employing the adhesive. Moreover, it is also preferred that the polymeric shrink wrap have a melting point which is lower than the melting point of the hot melt adhesive. Advantageously, the shrink wrap is able to melt along with the hot melt adhesive when subjected to heating by an end user of the adhesive. The resulting melt is able to flow without potentially plugging up piping and other conduit downstream to the exit of the melting pot.

It is preferred that the polymeric shrink wrap have a melt flow index ranging from about 1 to about 40 g/10 min., and more preferably from about 1 to about 10 g/10 min. The polymeric shrink wrap preferably has a thickness ranging from about 0.5 mil to about 1.0 mil, more preferably from about 0.5 mil to about 0.8 mil. Most preferably, the polymeric shrink wrap has a thickness of about 0.6 mil. The polymeric shrink wrap has an elongation preferably ranging from about 6 percent to about 80 percent, most preferably about 50 percent. The polymeric shrink wrap also has a seal strength preferably ranging from about 2800 g/in to about 4400 g/in. The polymeric shrink wrap has an Elmendorf tear strength preferably ranging from about 10 g to about 16 g.

In addition to the above, the polymeric shrink wrap preferably has: (1) a 50 percent shrinkage measured at 250° F., (2) a shrink force ranging from about 102 to about 255 g/in., (3) a tensile strength (based on a tensile of 12,000 psi) ranging from about 3,275 g/in to about 8,200 g/in., (4) a WTVR (water vapor transmission rate) ranging from about 0.6 to about 2.0 g/100 $in^2$/24 hr., and (5) an oxygen permeability ranging from about 175 to about 700 cc/100 $in^2$/24 hr/atm.

The invention will now be described in further detail with reference to the drawings. FIG. 1 depicts a shrink pack apparatus 300 which is used in a method of producing a packaged adhesive mass. A first sheet of polymeric shrink wrap in the form of a flat, non-folded film 301 is threaded onto a conveyor belt 302. A hot melt adhesive 307 in the form of a finite solid mass is then placed on top of the first sheet of polymeric shrink wrap film 301. Subsequently, the adhesive mass 307 and first sheet of polymeric shrink wrap film 301 are transported to station 308 where a second sheet of polymeric shrink wrap 304 is introduced. In the embodiment depicted in FIG. 1, the second sheet of polymeric shrink wrap film 304 is introduced via a gentle compressed gas stream 303 in fluid communication with station 308. Typically, air is employed in the gas stream, although other elements may be used. Similar to the first sheet 301, the second sheet of polymeric shrink wrap 304 is present in the form of a flat, non-folded film.

The second sheet of shrink wrap 304 and the adhesive mass 307 are then advanced to a sealing and cutting station 305. Here, the second sheet 304 is positioned over the adhesive mass 307 and is sealed thereon. The sheets of polymeric shrink wrap 301 and 304 are then cut so as to allow the adhesive mass 307 to be completely enveloped by the sheets of polymeric shrink wrap without excessive shrink wrap material being present. The adhesive mass 307 and shrink wrap is then moved to a shrink chamber 306. By employing hot gas (e.g., air) preferably at a temperature ranging from about 100° C. to about 200° C., the polymeric film shrinks tightly around the adhesive mass 307 to hermetically seal the adhesive. Upon exiting the shrink chamber, the packaged adhesive mass is completely non tacky, convenient in size, solid at ambient conditions, and able to be readily shipped in boxes, cartons, and the like.

Figure 2:
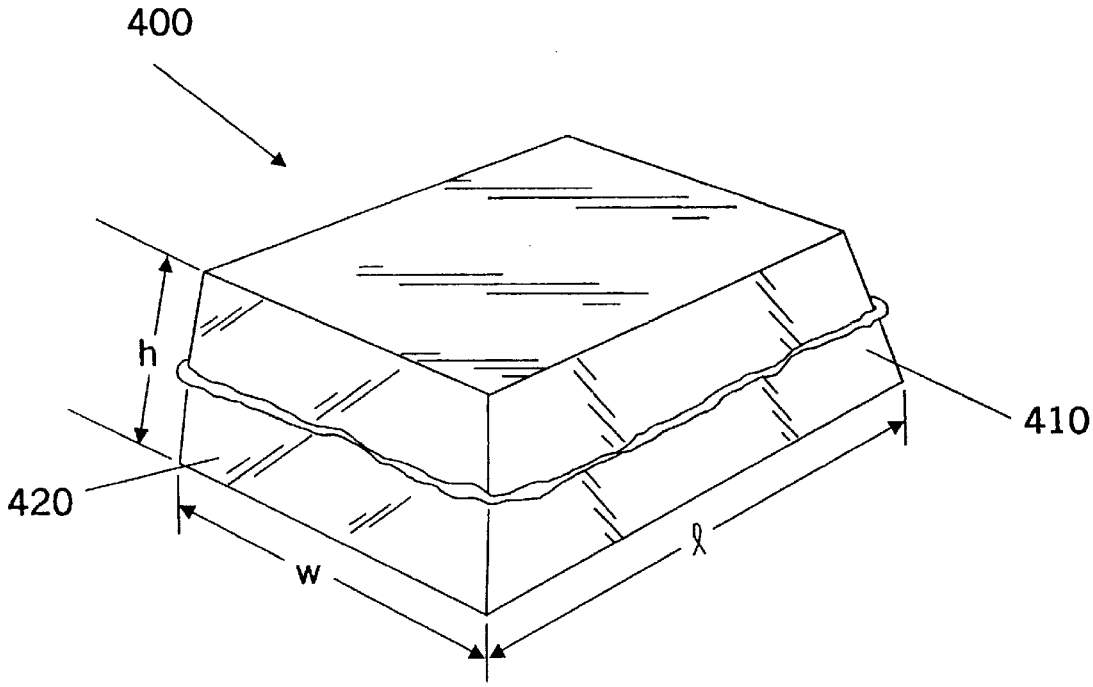
FIG. 2 is a perspective view of a hot melt adhesive mass which is encapsulated by polymeric shrink wrap.

FIG. 2 depicts a packaged hot melt adhesive mass 400 produced in accordance with the apparatus described in FIG. 1. As shown, the hot melt adhesive 410 is encapsulated by polymeric shrink wrap 420 such that adhesive is hermetically sealed. More specifically, it is preferred that polymeric shrink film has microperforations in an area density ranging from about 8 to 110 holes per square inch. It is believed that this allows for the air to escape during the shrinkage of the film which is wrapped tightly around the adhesive mass. The holes tend to close upon shrinkage. Although the packaged adhesive 400 depicted in this embodiment is a three-dimensional rectangular block, it should be appreciated that the package may be present in the form of other shapes and sizes which are known to one skilled in the art. Preferably, the package has a length l ranging from about 2 in. to about 18 in, a width w ranging from about 2 in. to about 10 in., and a height h ranging from about 1 in. to about 8 in. The packaged hot melt adhesive mass produced in accordance with the invention is highly advantageous. More specifically, by virtue of employing the polymeric shrink wrap, the article has a tack-free outer surface which allows it to be handled and transported without adhering to external surfaces upon contacting the same. The packaged article may also be present in a convenient size, and is solid and well protected under ambient transport and storage conditions. Accordingly, the article can be readily placed in boxes or other transport means. Also, as alluded to herein, the adhesive and shrink wrap are able to melt in the glue pot such that conduit downstream of the glue pot does not become clogged when the adhesive is discharged from the pot.

Figure 3:
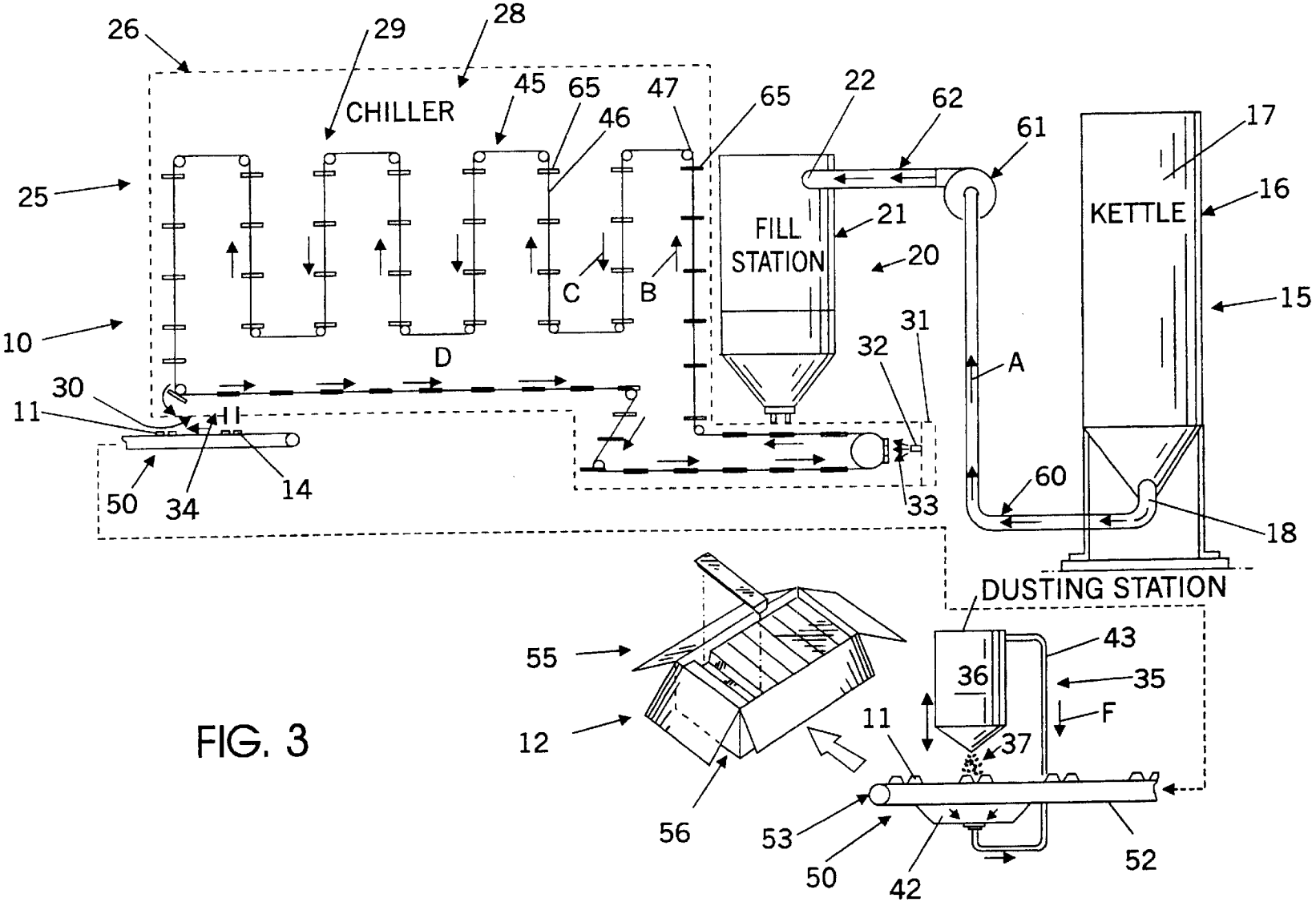
FIG. 3 is a perspective view of an alternative embodiment of an apparatus and methods for preparing hot melt adhesive masses.

Additional embodiments of the invention will now be described with reference to FIGS. 3–9. In particular, these drawings depict processing which the hot melt adhesive may undergo (e.g., chilling, dusting) prior to being encapsulated by the polymeric shrink wrap. Referring to FIG. 3, an embodiment of the apparatus 10 is shown. The apparatus includes a heating station 15, a filling station 20, a chilling station 25, an emptying station 30, a dusting station 35 and a packaging station 55 all operatively connected to process adhesive 14, preferably a hot melt adhesive, carried through the various stations by the apparatus 10 as indicated by directional arrows A–F. The heating station 15 includes a kettle 16 or other heating mechanism for heating a quantity of the adhesive 14, preferably to a molten state. The filling station 20 includes a filler 21 or other adhesive dispensing mechanism which is configured to dispense a quantity of hot melt adhesive 14 into a plurality of non-stick trays 65. Each tray 65 can be dusted prior to filling with a non-stick dusting agent by a dusting mechanism (not shown) similar to the dispenser 36 described herein. The trays 65 are connected with a conveyor 45 or other conveying mechanisms for moving the trays 65 through various stations described herein. The chilling station 25 includes a chiller 26 configured to receive the adhesive masses 11 onto a vibratory conveyor 50 in the dusting station 35. The dusting station 35 includes the vibratory conveyor 50 in the dusting station 35. The dusting station 35 includes the vibratory conveyor 50 and a dusting dispensing unit 36 attached above the vibratory conveyor 50. The dispenser 36 is configured to dust or coat the hot melt adhesive masses 11 with a non-stick agent such as a micronized wax 37. The vibratory conveyor 50 is configured to move the chilled, dusted hot melt adhesive masses 11 to the packaging station 55 where they are packaged in a shipping container illustrated as a corrugated box 56 without requiring additional packaging to provide a packaged, pressure sensitive, hot melt adhesive product 12.

Still referring to FIG. 3, the apparatus 10 is described in more detail. The kettle 16 has a drum 17, an outlet 18 and a heating mechanism (FIG. 3). The drum 17 is configured to receive a hot melt adhesive in a predetermined quantity. As depicted in FIG. 3, the kettle is preheated, preferably to about 350 degrees Fahrenheit. Individual raw material components are then introduced into the kettle 16. These components are melted and then preferably mixed to produce a homogeneous mixture. Examples of the components are described herein. A sample of the hot melt adhesive then can be taken from the kettle 16. These components are melted and then preferably mixed to produce a homogeneous mixture. A sample of the hot melt adhesive then can be taken from the kettle 16 for quality control testing. When the adhesive 14 within the kettle 16 meets manufacturing specifications, the adhesive 14 can then be pumped to the filling station 20 as described herein. The heating mechanism of the kettle 16 heats a volume of pressure sensitive, hot melt adhesive 14 to a temperature and viscosity, preferably in a molten state at a temperature about 150° C. to 200° C. and about 1–100 poise. The hot melt adhesive 14 is preferably heated to about 163° C. The kettle 16 preferably includes a thermometer or other heat detection mechanism for monitoring the temperature of the adhesive 14. The kettle 16 depicted in FIG. 3 continuously processes a volume of pressure sensitive, hot melt adhesive of about 5000 lbs. The kettle 16 is of a type known to one of ordinary skill in the art is not discussed in further detail herein. Other kettles 16 having a variety of capacities and configurations can be utilized.

The hot melt adhesive 14 illustrated in FIG. 3 is a pressure sensitive, hot melt adhesive composition. The pressure sensitive, hot melt adhesive composition is placed in the kettle 16. It should be emphasized that other types of hot melt adhesives can be utilized with the methods and apparatus of the present invention. The methods and apparatus 10 of the present invention can be utilized to process various volumes of hot melt adhesive 14, preferably ranging from about 1,000 to about 12,000 lbs, but also including smaller or larger quantities of hot melt adhesive. Additionally, various numbers of hot melt adhesive masses 11 can be formed and processed, including a single hot melt adhesive mass 11 can be formed and processed, including a single hot melt adhesive mass 11 and a plurality of hot melt adhesive masses 11. Also, the methods and apparatus 10 for preparing hot melt adhesives, including for packaging, according to the present invention can be utilized with varying volumes, weights, sizes and configurations of adhesives or other compositions. Still referring to FIG. 3, the hot melt adhesive 14 flows from the outlet 18 and a pump 61. The hot melt adhesive 14 flows through the first pipe 60 into the pump 61. The pump 61 illustrated in FIG. 1 is manufactured by Viking Pump, Cedar Rapids, Iowa as Model No. K225 and has a flow rate of about 10 gallons per minute (gal/min.). The pump 61 or other flow control mechanism maintains a desired flow of hot melt adhesive 14 from the kettle 16 to the filling station 20 by pumping the adhesive 14 through a second pipe 62 connected between the pump 61 and the filler 21. The flow rate of the pump 61 can be adjusted to alter or maintain the flow rate of the adhesive from the kettle 16 into the filler 21. Other pumps or flow control devices having different flow rates and which are known to one of skill in the art can also be provided.

In the filling station 20, the filler 21 receives the adhesive 14 in an inlet 22. The filler 21 shown illustrated in FIG. 3 is manufactured by Dick Hilton and Associates of Nashville, Tenn. The filler 21 has a capacity of 0.5 gallons and filling capacity of 2,000 pounds (lbs.) per hour. Preferably, the filler 21 receives adhesive as needed from the kettle 16.

Referring to FIGS. 3, 4, and 4A, in the filling station 20, the filler 21 provides a quantity of melted hot melt adhesive 14 to the plurality of trays 65, illustrated as non-stick trays, connected with the conveyor 45 for moving the trays through the various stations. Four nozzles 23, as illustrated direct the hot melt adhesive 14 at a flow rate of about 40 pounds per minute (lbs./min.) into the trays 65 during filling. Various configurations and combinations of filling nozzles or heads, including various filling rates, can also be utilized as will be readily apparent to one skilled in the art.

The filler 20 also preferably includes a positive cut-off mechanism. The positive cut-off mechanism (not shown) effects a generally clean cut or slice of the adhesive. This positive cut-off mechanism has been fabricated out of steel stock by Dick Hilton and Associates of Nashville, Tenn. Alternatively, other methods of cleanly severing the adhesive mass, including a heated wire or other severing mechanisms known to one in the art could be utilized and are not described in further detail herein. Other fillers and methods of filling can be utilized including other mechanical, hand operated, or automatically or robotically controlled filling apparatus or manual filling.

Referring to FIGS. 4 and 4A, the trays 65 are formed of aluminum. Aluminum is selected to provide the properties of the trays 65 which require the material to serve as a heat transfer medium, accept a non-stick coating, provide a rigid shape, maintain the shape at extremes of heat and cold and resist heat and cold temperature. Other suitable materials for forming the tray 65 include various steels, including stainless steels, aluminum and other like materials which can withstand extremes of heat and cold can be formed in a shape which is retained under such conditions. Each tray 65 contains an upper surface 66 and a floor portion 67 preferably generally parallel to the upper surface 66 and set apart a distance below the upper surface 66. Each tray 65 also has interior walls, including end walls 68 and side walls 69, between the floor 67 and upper surface 66. As seen in FIG. 2A, the side walls 69 are each also disposed at an angle $\alpha$ defined between the plane of the floor 67 and the plane of the side wall 69. The side walls 69, end walls 68 and floor 67 form the substantially trapezoidal shaped cavity 70. The angled side walls 69 facilitate the removal of the hot melt adhesive masses 11 after chilling as described herein.

The cavity 70 has an inner surface 71 formed by the inner surfaces of the floor 67, end walls 68 and side walls 69, which includes a non-stick coating such as a ceramic plasma coat from Impreglon® (FIG. 4A). Other non-stick coatings could be utilized including various plasma coats, various chemical coatings or other coatings including coatings sold under the trademarks Teflon®, Silverstone®, Supra®, nylon, PBDF and others. The ceramic plasma coat provides a non-stick inner surface 71 for the tray 65. As stated, the trays 65, alternatively, can be dusted with a non-stick dusting agent such as micronized polyethylene wax or the like prior to filling of the trays 65. As stated, the trays 65, alternatively, can be dusted with a non-stick dusting agent such as micronized polyethylene wax or the like prior to filling of the trays 65.

Referring to FIGS. 3, 4, and 4A, the cavities 70 of the trays 65 are filled with melted hot melt adhesive 14 by the nozzles 23 of the filler 21 into the cavities of the tray 65. The non-stick coating of the tray 65 prevents the melted hot melt adhesive 14 from adhering to the inner surfaces 71 of the respective cavities 70. The non-stick coating also facilitates the removal of the hot melt adhesive masses 11 from the cavities 70 of the tray 65 as described as occurring herein in the emptying station 30. In alternative embodiments, the dusting agent supplied to the tray 65 also facilitates the prevention of the hot melt adhesive 12 from adhering to the tray 65 and facilities removal of the masses 11 from the tray 65.

Referring now to FIGS. 4 and 5, the trays 65 also preferably include indicia molding mechanisms. For example, the trays 65 include raised indicia forms on the floor 67 (not shown). The indicia forms imprint indicia 13 in the surface 73 of the hot melt adhesive mass 11 produced in the tray 65 (FIG. 5). Such indicia 13 can include various patterns, designs, trademarks, logos or other markings as desired.

Referring now to FIG. 3, the trays 65 are connected with the belt 46 of a conveyor mechanism 45 which moves the trays 65 through the filling station 20, chilling station 25, emptying station 30, and back to the filling station 20. The conveyor mechanism 45 also includes a drive mechanism (not shown) and a plurality of pulleys 47. The belt 46 is moved by the drive mechanism over the pulleys 47 as indicated by the directional arrows B,C, and D of FIG. 3. The trays 65 can be moved through the chiller 26 by other conveyors or other moving mechanisms known to one of ordinary skill in the art, the details of which are not described herein.

With the trays 65 filled with hot melt adhesive 14, the belt 46 carries the filled trays 65 to the chilling station 25. The belt 46 passes through the inner chamber 29 of the chill cabinet 28 of the chiller 26 which is sized and configured to receive the plurality of the trays 65 containing melted hot melt adhesive 14.

As also shown in FIG. 3, the trays 65 are pivotally mounted with respect to the belt 46 of the conveyor mechanism 45. The trays 65 travel through the filling station 20 and chilling station 25 between the time of filling in the filling station 20 and the time of emptying in the emptying station 30 with openings 72 of cavities 70 generally opposite of the direction of the gravitational force as indicated by directional arrow E.

The chilling station 25 also includes a cryogen gas dispensing mechanism 31 having an outlet 32 which is positioned to supply cryogenic gas to the inner chamber 29 of the chill cabinet 28 suitable cryogen gases include $LN_2$ and $CO_2$ and the like. The cryogen gas dispensing mechanism 31 supplies cryogen gas 33 to the inner chamber 29 in a sufficient quantity to rapidly chill the hot melt adhesive masses 11 to a temperature of between about −5° C. to about −20° C. More preferably, the hot melt adhesive is present at a temperature of no greater than the glass transition temperature of the adhesive to eliminate surface tack. The chiller 26 as illustrated according to FIG. 3, chills a quantity of adhesive 14 of about 2,000 lbs. per hour. The chiller 26 can be configured of various dimensions and configured to receive various numbers of trays 65. In the chiller 26 shown in FIG. 3, the trays 65 and conveyor belt 46 are routed vertically and horizontally to maximize the number of trays 65 within the volume of the chiller 26. Various other chilling mechanisms can be provided to chill the adhesive rapidly from the temperature at the inlet of the chiller of about 163° C. to the chilled exit temperature in the range of about −5° C. to about −20° C. Such chilling mechanisms, including other chilling mediums, can be dispensed into the inner chamber 29, or directly onto the adhesive.

The temperature of the chill cabins 28 can be controlled by the temperature and amount of cryogen gas 33 discharged therein. The residence time and temperature needed for chilling of the adhesive 14 is dependent on the amount of cooling medium or cryogen gas 33 discharged to the chill cabinet 28, the volume of the chill cabinet 28 and the total mass and entry temperature of the adhesive within the chill cabinet 28. Thus, various configurations of chillers having chill cabinets of varying sizes and shapes can be provided to chill a range of volumes of hot melt adhesive masses 11. In the apparatus 10 of FIG. 3, the residence time of each hot melt adhesive mass 11 is about 60 to 600 seconds for each hot melt adhesive mass 11 having a weight of about 1.1 pounds (lbs.).

One of ordinary skill in the art can perform standard heat capacity calculations and other calculations to determine the residence time required and chilling temperature required for a particular amount of adhesive to reduce temperature of the adhesive from a particular first inlet temperature to a desired second outlet temperature. Variables including residence time, chilling temperature, type of chilling medium, inlet and outlet temperatures and type of adhesive can be adjusted to configure the apparatus and utilize the methods for various applications. The details of calculations associated with adjusting these and other variables are known to one of ordinary skill in the art and are not described in detail herein.

Referring still to FIG. 3, the trays 65 travel through the chiller 26 to the outlet 34 of the chiller 26 where they enter the emptying station 30. As the trays 65 travel through the emptying station 30, the opening 72 of each of the cavities 70 of the trays 65 is pivoted from a generally upright position opposite to the force of gravity to a position towards the gravitational force at an angle sufficient for the adhesive masses to gravitationally exit from the trays indicated by direction arrow E (FIG. 3). The hot melt adhesive masses 11 gravitationally exit from the trays 65 onto the vibratory conveyor 50 and enter the dusting station 35. The trays 65 can be moved to a position to facilitate gravitational exiting by other moving mechanisms such as pivoting or moving mechanisms are known to one of skill in the art and are not described in detail herein.

Once the trays 65 have been emptied of the hot melt adhesive masses 11, the trays 65 are returned to the filling station 20, and are thereby refilled. Thus, the trays 65 are preferably reused numerous times to continue refilling and producing hot melt adhesive masses 11.

In the dusting station 35, the vibratory conveyor 50 includes a belt 52, a drive mechanism and a vibration mechanism. As shown in FIG. 3, the wax dispenser 36 is operatively connected with the vibratory conveyor 50 and positioned above the conveyor 50.

The wax dispenser 36 includes a sieve screen. A quantity of micronized wax 37 is positioned in the wax dispenser above the sieve screen. The sieve screen illustrated has a mesh of between about 8 mesh and about 200 mesh. The mesh of the sieve screen is selected to facilitate dusting of the hot melt adhesive masses 11 with the micronized polyethylene wax 37 or other dusting agent. The size of the mesh of the sieve screen is selected based on the dusting agent particle size. The particle size of the wax is preferably between about 36–44 microns in the embodiment of FIGS. 3–8. The wax 37, depicted in FIGS. 3–8, is manufactured by Lonza Chemical, Williamsport, Pa. Alternatively, various configurations of sieve screens or other metered dispensing mechanisms can be utilized with this dusting agent dispenser according to the present invention.

The vibratory conveyor 50 is configured to vibrate horizontally. The wax dispenser 36 is operatively connected with the vibratory conveyor 50 and likewise vibrates. As the wax dispenser 36 vibrates horizontally, the wax 37 is dispensed through the screen onto the hot melt adhesive masses 11 (FIG. 3).

Figure 8:
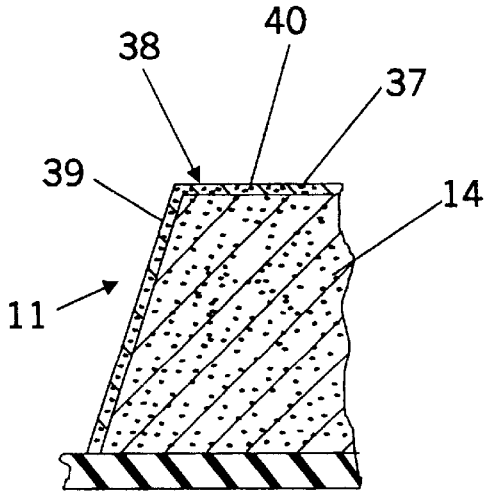
FIG. 8 shows a cross-section view of a hot melt adhesive mass taken along line 6—6 of FIG. 5.

Referring to FIGS. 3 and 8, the wax 37 dispensed onto the hot melt adhesive masses 11 by the wax dispenser 36 provides a dusting or coating 38 to the outer surface 39 of the hot melt adhesive mass 11. The wax coating 38 as illustrated in FIG. 6 is provided to the surface 40 of the chilled; hot melt adhesive 14 such that the dusted, hot melt adhesive masses 11 maintain a substantially tack-free outer surface 39 at temperatures between about 0° C. and 75° C. The hot melt adhesive masses 11 are dusted with the micronized polyethylene wax 37, preferably, such that the wax 37 comprises between about 0.01% and 2.0% of the total weight of the adhesive mass. Various other high melt point polyethylene waxes which are micronized can be used. Alternatively, wax dispensing mechanisms can be utilized including sprays, baths or other methods of providing a wax coating to the adhesive masses. Additionally, other suitable coatings can be supplied to the masses 11 for providing a tack-free surface including like coatings which have a lower melting temperature than the hot melt adhesive and which will not deleteriously affect the adhesive properties of the hot melt adhesive when the adhesive is processed.

As described, the adhesive 14 is filled into the trays 65 in a molten state. As the adhesive is chilled, it is transformed from a molten state at the inlet of the chiller 26 to preferably a solid state upon exiting the chiller 26 at the outlet 34 of the chiller. The rapid chilling reduces the tackiness of the hot melt adhesive mass 11 such that individual masses 11 have a reduced tackiness. This is achieved at approximately the glass transition temperature of the adhesive. As the masses return to temperatures between 0° C. and 75° C., the adhesive masses maintain a substantially tack-free outer surface 39. As illustrated in FIG. 3, the dusted hot melt adhesive masses 11 travel to an end 53 of the vibratory conveyor 50 where they are collected for packaging in the apparatus described in FIG. 1.

Referring again to FIG. 3, the vibratory conveyor 50 also includes slots (not shown) through which the excess wax 37 which is not adhered to the hot melt adhesive masses 11 is collected in a recirculation bin 42 and returned to the wax dispenser mechanism 36 via pipe 43 by a vacuum mechanism or other recirculation means as indicated in the direction of directional arrow F. Various recirculation mechanisms including conveyor belts, buckets or manual recirculation can be utilized to recirculate wax to the wax dispenser mechanism 36, thereby reducing waste. Upon completion of the dusting, the dusted, chilled masses 11 are moved to the system described in FIG. 1.

The resulting chilled, dusted hot melt adhesive masses 11 are illustrated in FIG. 5. The hot melt adhesive masses 11 have a generally trapezoidal shape determined by the shape of the tray 65. The masses 11 generally retain the shape at room temperature. Hot melt adhesive masses 11 of various shapes can be formed by molds of varying shapes.

Referring again to FIG. 3, in the packaging station 55 the hot melt adhesive masses 11 are packaged in the corrugated paper box 56 (FIGS. 3 and 6). Other containers can be provided including bags, films including polymer containers of various configurations. The dusted, chilled shrink wrapped hot melt adhesive masses are packaged in the container 56 in this embodiment without necessitating additional packaging separating each hot melt adhesive mass 11.

As shown in FIG. 6, a plurality of the pressure sensitive, hot melt adhesive masses 11 are positioned in the inner cavity of the container 56 such that outer surfaces 75 of the masses 11 contact the surfaces 76 of adjacent masses 11' (FIGS. 6 and 7). The wax 57 is supplied to the adhesive 14 in sufficient quantity to prevent adhesion of the masses at temperatures ranging from about 0° C. to about 75° C. The plurality of hot melt adhesive masses can be packed in the box 56 free of additional packaging material separating adjacent adhesive masses 11, 11' with the surface of the plurality of adhesive masses 11 contacting surfaces of adjacent masses 11' without substantially adhering.

As also illustrated in FIG. 6, the plurality of the dusted, chilled, hot melt adhesive masses 11 are stacked into three layers 80, 85, 90. The masses 81, 82 of the first layer 80 are positioned generally horizontally adjacent one another. Adjacent vertical edges 83, 84 of the first layer 80 contact without additional packaging between the adjacent edges and without contacting edges 83, 84 adhering. The trapezoidal shape of the hot melt adhesive masses 11, 11', 81, 82 facilitates packaging the masses in alternating vertical orientations such that a plurality of trapezoids can form generally congruent horizontal layers 80, 85, 90.

Still referring to FIG. 6, the packaged, pressure sensitive, hot melt adhesive product of this embodiment contains about 24 pressure sensitive, hot melt adhesive masses 11 packaged in three layers 80, 85, 90 with eight pressure sensitive, hot melt adhesive masses 11 in each of the layers 80, 85, 90. Each pressure sensitive, hot melt adhesive mass 11 weighs between about 1.0 and 1.1 pounds (lbs.). The hot melt adhesive masses 11 can be provided in a variety of weights. Likewise, the packaged, hot melt adhesive product 12 can be provided containing a variety of weights and numbers of hot melt adhesive masses 11. The packaged, hot melt adhesive product 12 contains twenty-four (24) masses 11 weighing a total of about twenty-five (25) pounds (lbs.). In the packaged, hot melt adhesive product 12, each hot melt adhesive mass 11 of the first layer 80, for example hot melt adhesive mass 81, supports a weight of two (2) pounds (lbs.) supplied by the two one (1) pound (lbs.) hot melt adhesive masses 86, 91B positioned above the hot melt adhesive mass 81 in the second layer 85 and the third layer 90. The hot melt adhesive masses 81 of the first layer 80 sufficiently support the weight of the hot melt adhesive masses 86 of the second layer 85 and third layer 90 without additional supports such that the hot melt adhesive masses 81 of the first layer 80 and subsequent hot melt adhesive masses 86, 91 of the second and third layers 85, 90 (respectfully) retain their shape during packaging or shipping. Likewise, the hot melt adhesive masses 86 of the send layer 85 each support about one pound of the single hot melt adhesive mass 91 above the third layer 90. Also, likewise, the hot melt adhesive masses 86, 91 of the second and third layer 85,90 do not deform due to weight of other hot melt adhesive masses.

Referring to FIGS. 6 and 7, the packaged, pressure sensitive, hot melt adhesive product 12 is thereby provided which can be packaged and shipped without necessitating additional packaging between individual hot melt adhesive masses 11, 11' such that adjacent outer surfaces 75, 76 of the hot melt adhesive masses 11, 11' contact without adhering at temperatures experienced in normal shipping, storage and use, preferably in the range of between about −40° C. and 75° C. (FIG. 6). Further, the packaged hot melt adhesive product 12 is provided which can be utilized in hot melt adhesive applications without necessitating the unwrapping of packaging from individually wrapped hot melt adhesive masses 11 (FIG. 7).

The packaged, pressure sensitive, hot melt adhesive product 12 is provided containing individual hot melt adhesive masses or bricks which can be directly removed from the box 56 for processing in a glue pot 95 without removing any additional packaging (FIG. 7). Such a packaged, hot melt adhesive product 12 facilitates the ease of use and the repetitive steps and costs be provided containing a variety of weights and numbers of hot melt adhesive masses 11. The packaged, hot melt adhesive product 12 contains twenty-four (24) masses 11 weighing a total of about twenty-five (25) pounds (lbs.). In the packaged, hot melt adhesive product 12, each hot melt adhesive mass 11 of the first layer 80, for example hot melt adhesive mass 81, supports a weight of two (2) pounds (lbs.) supplied by the hot melt adhesive mass B81B in the second layer B85B and the third layer 90. The hot melt adhesive masses 81 of the first layer 80 sufficiently support the weight of the hot melt adhesive masses 86 of the second layer 85 and third layer 90 without additional supports such that the hot melt adhesive masses 81 of the first layer 80 and subsequent hot melt adhesive masses 86, 91 of the second and third layers 85, 90 (respectfully) retain their shape during packaging or shipping. Likewise, the hot melt adhesive masses 86 of the second layer 85 each support about one pound of the single hot melt adhesive mass 91 above in the third layer 90. Also, likewise, the hot melt adhesive masses 86, 91 of the second and third layer 85, 90 do not deform due to weight of other hot melt adhesive masses.

Referring to FIGS. 6 and 7, the packaged, pressure sensitive, hot melt adhesive product 12 is thereby provided which can be packaged and shaped without necessitating additional packaging between individual hot melt adhesive masses 11, 11' such that adjacent outer surfaces 75, 76 of the hot melt adhesive masses 11, 11' contact without substantially adhering at temperatures experienced in normal shipping, storage and use, preferably in the range of between about −40° C. and 75° C. (FIG. 6). Further, the packaged hot melt adhesive product 12 is provided which can be utilized in hot melt adhesive applications without necessitating the unwrapping of packaging from individually wrapped hot melt adhesive masses 11 (FIG. 7).

The packaged, presser sensitive, hot melt adhesive product 12 is provided containing individual hot melt adhesive masses or bricks which can be directly removed from the box 56 for processing in a glue pot 95 without removing any additional packaging (FIG. 7). Such a packaged, hot melt adhesive product 12 facilitates the ease of use and the repetitive steps and costs associated with opening individually packaged hot melt adhesive masses of prior products.

Still referring to FIG. 7, the hot melt adhesive masses 11 in the form of trapezoidal bricks, can be used in typical processing applications for hot melt adhesives, including but not limited to adhesives for paper and film coating for various labels. Having provided a pressure sensitive, hot melt adhesive packaged product 12 as described herein, the non-adhered pressure sensitive, hot melt adhesive masses or bricks 11 can be removed from the box 56 at temperatures between about −40° C. and 75° C. and introduced into the glue pot 95 or other hot melt adhesive processing apparatus for melting and blending without removing any packaging from individual hot melt adhesives is well known to one of ordinary skill in the art and is not described herein.

The hot melt adhesive masses 11 do not adhere with adjacent hot melt adhesive masses 11' at temperatures ranging from about −40° C. and 75° C. As the temperature of the hot melt adhesive mass 11 rises from the temperature of the hot melt adhesive mass 11 as it exits the chiller 26 to the room temperature prior to processing the mass 11 in the glue pot 95, the masses 11 do not adhere. The hot melt adhesive masses 11 substantially maintain their shape as the temperature rises. This is important as processing of the masses 11 in end applications often occurs at locations remote from the location of packaging. The packaged hot melt products 12 described according to the present invention are suitable for transport by conventional means such as trucking, air, rail or sea without individual hot melt adhesive masses 11 adhering and without requiring any refrigeration or temperature control.

The methods and apparatus of preparing the hot melt adhesive masses 11 for packaging are illustrated as a continuous process utilizing a continuous system up to processing (FIG. 3). Alternatively, batch processing can be utilized such that only an amount of hot melt adhesive is heated as can be chilled in one step. Further, the various steps or apparatus pieces can be located at spatially distant positions if desired. Various steps can be performed manually, by automation or mechanisms or by a combination thereof. For example, the hot melt adhesive 14 can be transported manually through various stations, such as the filling station 20, chilling station 25, emptying station 30, dusting station 35 and the like.

Referring to FIG. 9, an alternative embodiment of the packaged, pressure sensitive, hot melt adhesive product 100. This packaged, pressure sensitive, hot melt adhesive product 100 contains dusted, chilled, pressure sensitive, hot melt adhesive masses 11 produced by the methods and apparatus described herein with respect to FIGS. 3–8. This package, pressure sensitive, hot melt adhesive product 100 includes a plurality of pressure sensitive, hot melt adhesive masses 11 as described with a separation layer of separator of non-stick or release coated material, illustrated as silicon paper 101, between each of three layers 102, 103, 104 and a lower surface 105 of box 107. While such silicone paper 101 is not necessary to prevent adhesion of the masses 11, the silicone paper 101 between the layers 101, 102, 103 and the box 107 facilitates removal of the masses 11 for end use in various applications of the hot melt adhesive 14. Other non-stick, or release separator materials or the like, which sill not substantially adhere to themasses can be utilized to facilitate removal of the individual hot melt adhesive mass packaging materials can be utilized if desired.

The packaged hot melt adhesive products 12, 100 of the various embodiments are illustrated as having been manually packaged and manually unpacked by an operator L (FIG. 7). Alternatively, packaging mechanisms and apparatus can be provided to package adhesive masses in producing the packaged, hot melt pressure sensitive adhesive products 12, 100 and likewise to remove the hot melt adhesive masses 11 from the boxes 56, 107.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. A packaged adhesive mass comprising:

a hot melt adhesive having a predetermined viscosity and finite size and shape; and a polymeric shrink wrap having a thickness ranging from about 0.5 mil to about 1.0 mil and a shrink force ranging from about 102 g/in to about 255 q/in, wherein said polymeric shrink wrap encapsulates said hot melt adhesive such that said hot melt adhesive is hermetically sealed.

2. The packaged adhesive mass according to claim 1, wherein said hot melt adhesive has a height ranging from about 1 to about 8 inches, a width ranging from about 2 to about 18 inches, and a length ranging from about 2 to about 18 inches.

3. The packaged adhesive mass according to claim 1, wherein the hot melt adhesive comprises a material selected from the group consisting of polyolefins, polyacrylates, polyvinyl acetates, ethylene esters, polystyrenes, polyesters, polyamides, polyvinyl alcohols, polyurethanes, polyepoxides, aldehyde-containing resins, blends thereof, and mixtures thereof.

4. The method according to claim 1, wherein the hot melt adhesive further includes a component selected from the group consisting of a tackifier, a plasticizer, a wax, an antioxidant, and mixtures thereof.

5. The packaged adhesive mass according to claim 1, wherein the polymeric shrink wrap is formed from at least one polyolefin or polyolefin copolymer.

6. The adhesive article according to claim 5, wherein the at least one polyolefin or polyolefin copolymer is selected from the group consisting of polyethylenes, polypropylenes, polyvinyl ethylene, vinyl acetate, blends thereof, and mixtures thereof.

7. The adhesive article according to claim 1, wherein the melting point of said polymeric shrink wrap is equal to or lower than about 266° F.

8. The adhesive article according to claim 1, wherein the melting point of the polymeric shrink wrap is lower than the application temperature of the hot melt adhesive.

* * * * *